US010127842B2

(12) United States Patent
McDaniel

(10) Patent No.: US 10,127,842 B2
(45) Date of Patent: Nov. 13, 2018

(54) LINERLESS COMBINED MAILING LABEL AND RETURN LABEL AND METHOD OF MANUFACTURING SAME

(75) Inventor: Robert McDaniel, Rogersville, TN (US)

(73) Assignee: Iconex LLC, Duluth, GA (US)

( * ) Notice: Subject to any disclaimer, the term of this patent is extended or adjusted under 35 U.S.C. 154(b) by 199 days.

(21) Appl. No.: 13/485,402

(22) Filed: May 31, 2012

(65) Prior Publication Data

US 2013/0320661 A1 Dec. 5, 2013

(51) Int. Cl.

| | |
|---|---|
| ***G09F 3/10*** | (2006.01) |
| ***G09F 3/00*** | (2006.01) |
| *G09F 3/02* | (2006.01) |

(52) U.S. Cl.

CPC ..... *G09F 3/0288* (2013.01); *G09F 3/10* (2013.01); *G09F 2003/022* (2013.01); *G09F 2003/026* (2013.01); *G09F 2003/0213* (2013.01); *G09F 2003/0267* (2013.01); *G09F 2003/0269* (2013.01)

(58) Field of Classification Search

CPC ..... B42D 15/00; B42D 15/10; B42D 5/015; G09C 3/00; G09F 3/0288; G09F 3/10; G09F 2003/0267; G09F 2003/026; G09F 2003/0269; G09F 2003/0213; G09F 2003/022

USPC ..... 283/72, 74, 81, 94, 98, 100, 103, 901; 156/40.1, 41.8, 42.2, 42.3, 248, 249, 252, 156/253, 268, 289, 290

See application file for complete search history.

(56) References Cited

U.S. PATENT DOCUMENTS

| | | | |
|---|---|---|---|
| 3,312,005 | A | 4/1967 | Mcelroy |
| 5,752,722 | A | 5/1998 | Moore et al. |
| 2002/0193225 | A1 | 12/2002 | Raming |

(Continued)

FOREIGN PATENT DOCUMENTS

| | | | |
|---|---|---|---|
| CN | ZL2013102107448.X | | 12/2016 |
| EP | 1229509 | A2 | 8/2002 |

(Continued)

OTHER PUBLICATIONS

"European Application Serial No. 13164798.4, Invitation pursuant to Rule 137(4) EPC and Article 94(3) EPC dated Apr. 5, 2017", 3 pgs.

(Continued)

*Primary Examiner* — Justin V Lewis

(74) *Attorney, Agent, or Firm* — Schwegman Lundberg & Woessner, P.A.

(57) ABSTRACT

A combined primary label and secondary label comprises a first piece of paper, a first release coating disposed on a portion of the first piece of paper, a second piece of paper, a second release coating different from the first release coating and disposed on a portion of the second piece of paper. The combined primary and secondary label further comprises an adhesive layer disposed between the first and second pieces of paper such that (i) a primary label can be peeled away with at least some adhesive of the adhesive layer from the second release coating disposed on the portion of the second piece of paper, and (ii) a secondary label can be peeled away with at least some adhesive of the same adhesive layer from the first release coating disposed on the portion of the first piece of paper.

13 Claims, 4 Drawing Sheets

(56) References Cited

U.S. PATENT DOCUMENTS

| | | | | |
|---|---|---|---|---|
| 2004/0188009 | A1* | 9/2004 | McKillip | B42D 5/00 156/252 |
| 2012/0234481 | A1* | 9/2012 | Raming | G09F 3/0288 156/249 |

FOREIGN PATENT DOCUMENTS

| | | | |
|---|---|---|---|
| EP | 1 229 509 | | 4/2004 |
| JP | 2000-019972 | A | 1/2000 |
| JP | 2006-181991 | A | 7/2006 |
| JP | 6275394 | B2 | 1/2018 |

OTHER PUBLICATIONS

"Japanese Application Serial No. 2013-090711, Office Action dated Apr. 14, 2017", (w/ English Translation), 21 pgs.
"European Application Serial No. 13164798.4, Extended European Search Report dated Feb. 21, 2014", 8 pgs.
"European Application Serial No. 13164798.4, Response filed May 22, 2014 to Extended European Search Report dated Feb. 21, 2014", 9 pgs.

* cited by examiner

LINERLESS COMBINED MAILING LABEL AND RETURN LABEL AND METHOD OF MANUFACTURING SAME

BACKGROUND

The present application relates to mailing labels and return labels, and is particularly directed to a linerless combined mailing label and return label and method of manufacturing same.

A known combined mailing label and return label includes two pieces of thermal paper in which one piece is used as a mailing label and the other piece is used as a return label. A release liner is provided between pressure-sensitive glue which is disposed on the backside of the mailing label and pressure-sensitive glue disposed on the backside of the return label. The release liner allows mailing label along with its pressure-sensitive glue to be cleanly peeled away from one side of the release liner, and return label along with its pressure-sensitive glue to be cleanly peeled away from the other side of the release liner. It would be desirable to provide a combined mailing label and return label which is less expensive and which is easier to manufacture.

SUMMARY

In accordance with one embodiment, a combined primary label and secondary label comprises a first piece of paper, a first release coating disposed on a portion of the first piece of paper, a second piece of paper, a second release coating different from the first release coating and disposed on a portion of the second piece of paper. The combined primary and secondary label further comprises an adhesive layer disposed between the first and second pieces of paper such that (i) a primary label can be peeled away with at least some adhesive of the adhesive layer from the second release coating disposed on the portion of the second piece of paper, and (ii) a secondary label can be peeled away with at least some adhesive of the same adhesive layer from the first release coating disposed on the portion of the first piece of paper.

DETAILED DESCRIPTION

Figure 1:
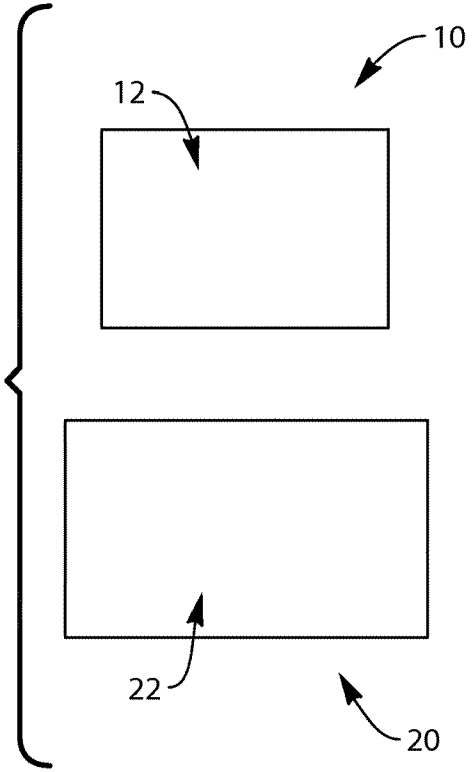
FIG. 1 shows backside views of first and second thermal paper portions used in the construction of a linerless combined mailing label and return label in accordance with one embodiment.

Referring to FIG. 1, a first piece 10 of material and a second piece 20 of material are provided to form a combined mailing label and return label in accordance with one embodiment as will be described herein. The first piece 10 of material has a front major surface 11 (shown in FIG. 5) and a back major surface 12. The front major surface 11 of the first piece 10 of material has a thermal-sensitive coating disposed thereon. Similarly, the second piece 20 of material has a front major surface 13 (shown in FIG. 5) and a back major surface 22. The front major surface 13 of the second piece 20 of material has a thermal-sensitive coating (also not shown) disposed thereon. Size of the second piece 20 of material is larger than size of the first piece 10 of material such as shown in FIG. 1.

Figure 2:
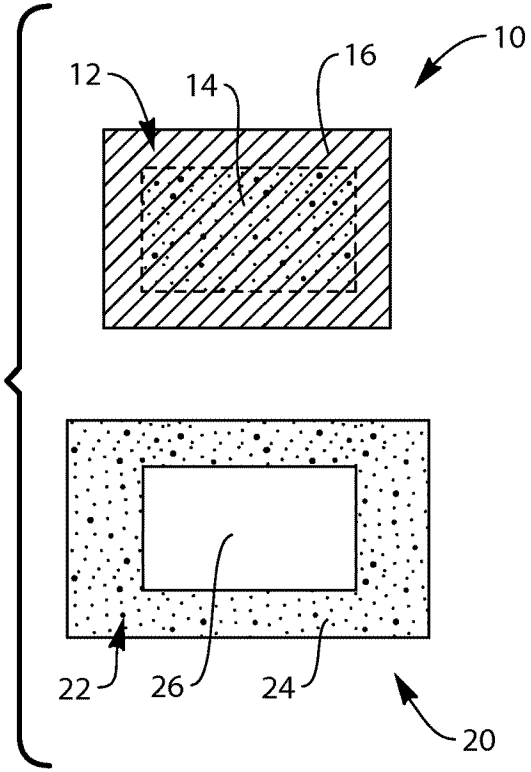
FIG. 2 is similar to FIG. 1, and shows a release coating and a pressure-sensitive glue disposed on the first thermal paper portion of FIG. 1, and a release coating disposed on the second thermal paper portion of FIG. 1.

As shown in FIG. 2, a first release coating 14 is disposed on a substantially rectangular-shaped central portion of the backside 12 of the first piece 10 of material. A layer adhesive in the form of pressure-sensitive glue 16 covers the first release coating 14 and is disposed on substantially the entire backside 12. Also, as shown in FIG. 2, a second release coating 24 is disposed on a substantially frame-shaped area of the backside 22 of the second piece 20 of material. The second release coating 24 and the first release coating 14 may be the same or different from each other. The frame-shaped second release coating 24 forms a central rectangular area 26 which is devoid of second release coating 24. The size of rectangular area 26 on the back side 22 of the second piece 20 of material substantially corresponds to the size of the rectangular-shaped first release coating 14 on the backside 12 of the first piece 10 of material.

Figure 3:
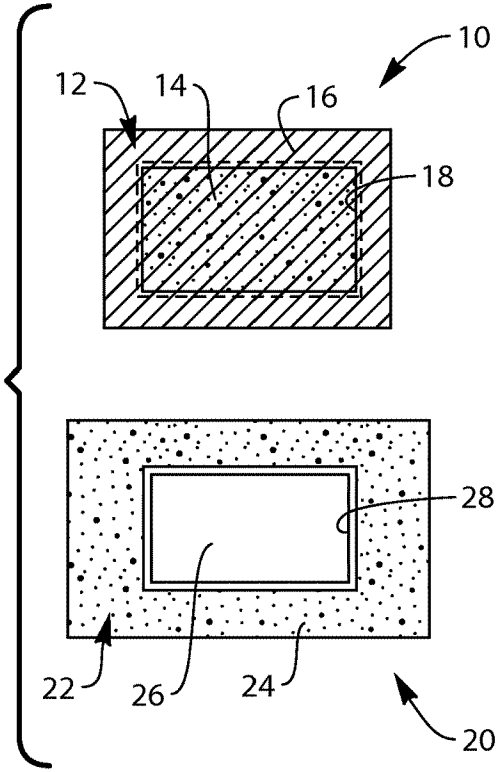
FIG. 3 is similar to FIGS. 1 and 2, and shows a perforation in the first thermal paper portion of FIGS. 1 and 2, and a die cut in the second thermal paper portion of FIGS. 1 and 2.

As shown in FIG. 3, a substantially rectangular-shaped perforation 18 is formed in the first piece 10 of material. The size of the rectangular-shaped perforation 18 corresponds to about the same size as the rectangular-shaped first release coating 14. A substantially rectangular-shaped die cut 28 is formed in the second piece 20 of material. The rectangular-shaped die cut 28 corresponds to about the same size as the central rectangular area 26 which is devoid of second release coating 24. The rectangular-shaped perforation 18 may be slightly larger than the rectangular-shaped die cut 28.

Figure 5:
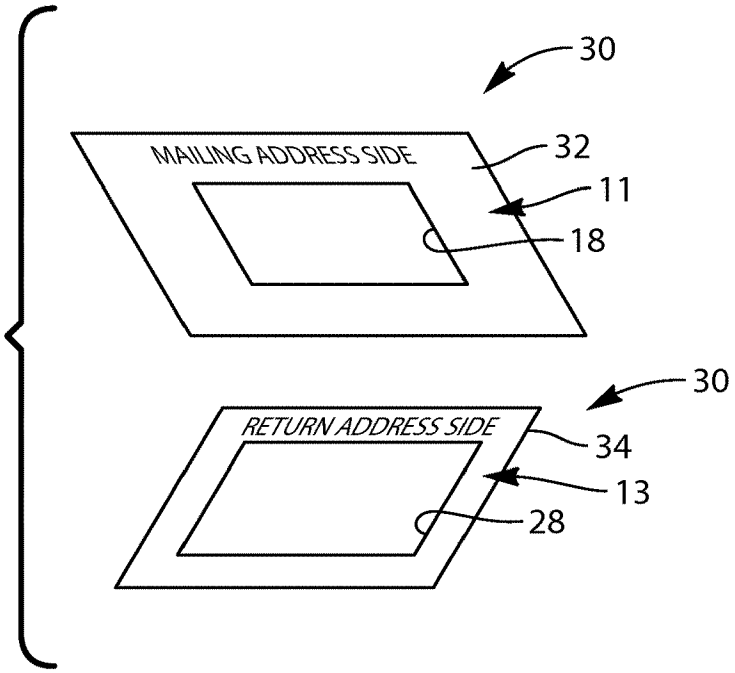
FIG. 5 is a perspective view showing mailing address side of the blank linerless combined mailing label and return label of FIG. 4, and return address side of the blank linerless combined mailing label and return label of FIG. 4.
Figure 4:
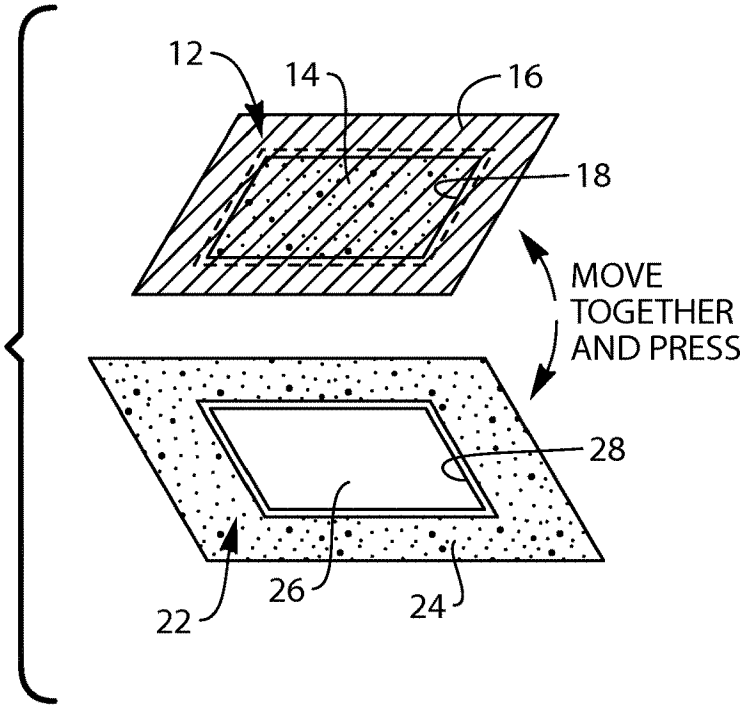
FIG. 4 is a perspective view showing the first and second thermal paper portions of FIG. 3 being assembled together to form a blank linerless combined mailing label and return label.

Referring to FIG. 4, the backside 12 of the first piece 10 of material and the back side 22 of the second piece 20 of material are moved towards each other and pressed together to form a blank combined mailing label and return label. When the backside 12 and the back side 22 of the first and second pieces 10, 20 of material engage, a frame-shaped glue portion of the pressure-sensitive glue 16 engages with and adheres to the frame-shaped second release coating 24. Also, a rectangular-shaped glue portion of the pressure-sensitive glue 16 on the backside 12 of the first piece 10 adheres to the central rectangular area 26 of the back side 22 of the second piece 20 devoid of second release coating 24. The blank combined mailing label and return label formed is shown in FIG. 5, and is designated with reference numeral "30". Mailing address side 32 of the combined label 30 is shown at top of FIG. 5, and return address side 34 of the combined label is shown at bottom of FIG. 5. The combined mailing label and return label 30 is now ready to be used.

Figure 6:
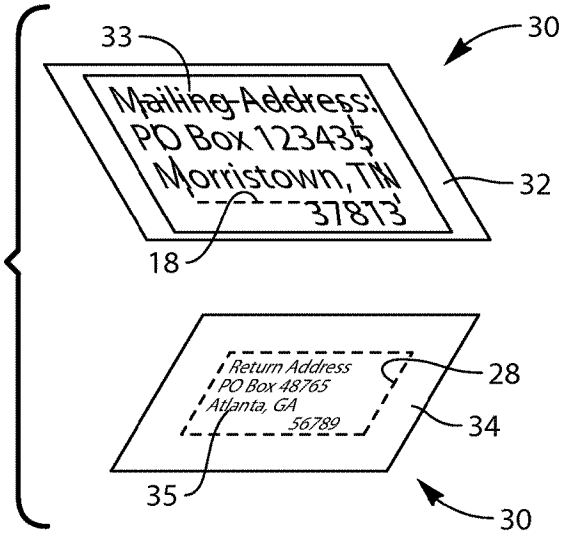
FIG. 6 is similar to FIG. 5, and shows a mailing address printed on the mailing address side, and a return address printed on the return address side of the linerless combined mailing label and return label of FIG. 5.
Figure 7:
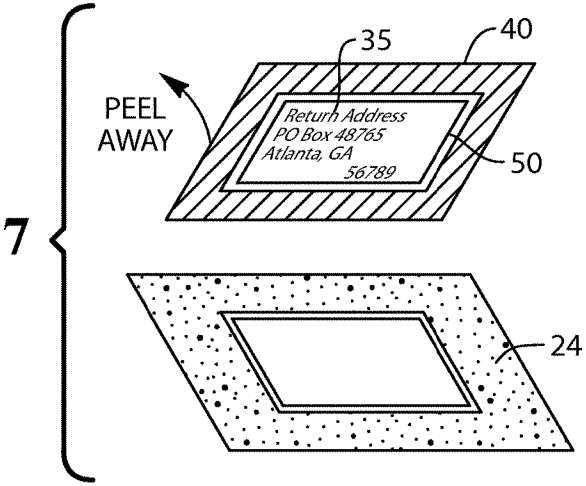
FIG. 7 is a perspective view showing mailing label being removed and ready to be applied to a mailing package to be mailed to the mailing address of FIG. 6.

During use of the combined mailing label and return label 30, a mailing address 33 is printed on the mailing address side 32, and a return address 35 is printed on the return address side 34, as shown in FIG. 6. Then, as shown in FIG. 7, mailing label 40 is peeled away and can be applied to a mailing package to be sent to the recipient indicated in the mailing address 33 (FIG. 6) printed on the mailing address side 32. While mailing label 40 is being peeled away, return label 50 is also peeled away and is attached to the back of mailing label 40 as shown in FIG. 7. This occurs because of the rectangular-shaped glue portion of the pressure-sensitive glue 16 (which overlies the rectangular-shaped first release coating 14 shown in FIG. 3) adhering to the rectangular area 26 and the presence of the die cut 18 formed in the second piece 20 of material. Thus, return label 50 breaks away at its die ties as mailing label 40 is being peeled away as shown in FIG. 7, and is attached to the back of mailing label 40 by way of the rectangular-shaped glue portion. Dimensions of the die cut 18 defines dimensions of return label 50.

Figure 8:
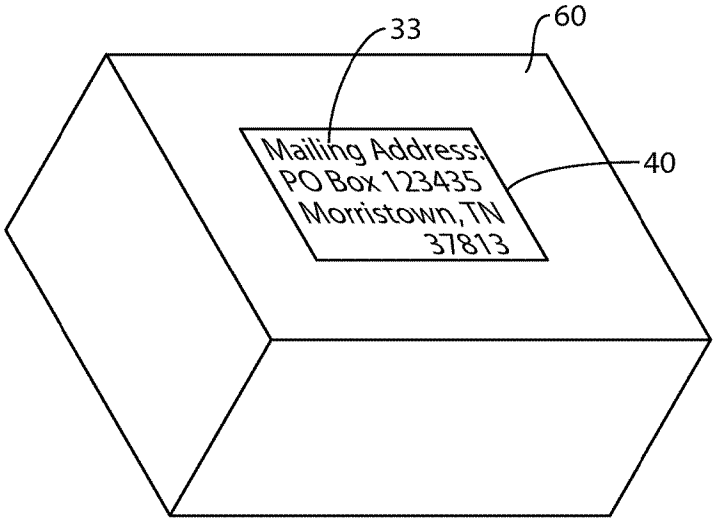
FIG. 8 is a perspective view showing the removed mailing label of FIG. 7 applied to a mailing package to be mailed to the mailing address of FIG. 6.
Figure 10:
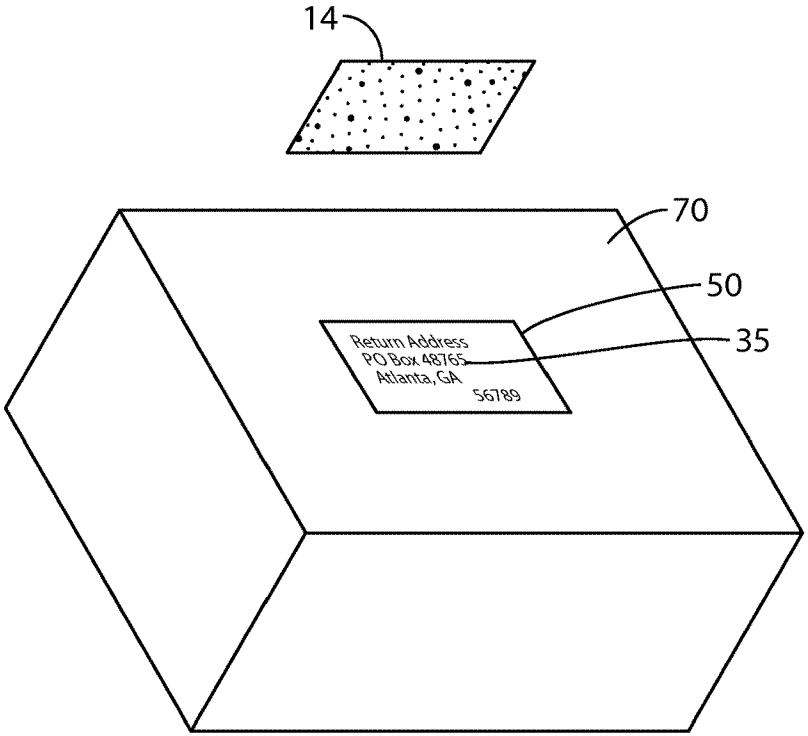
FIG. 10 is a perspective view showing the removed return label of FIG. 9 peeled away and applied to a return package to be returned to the return address of FIG. 6.
Figure 9:
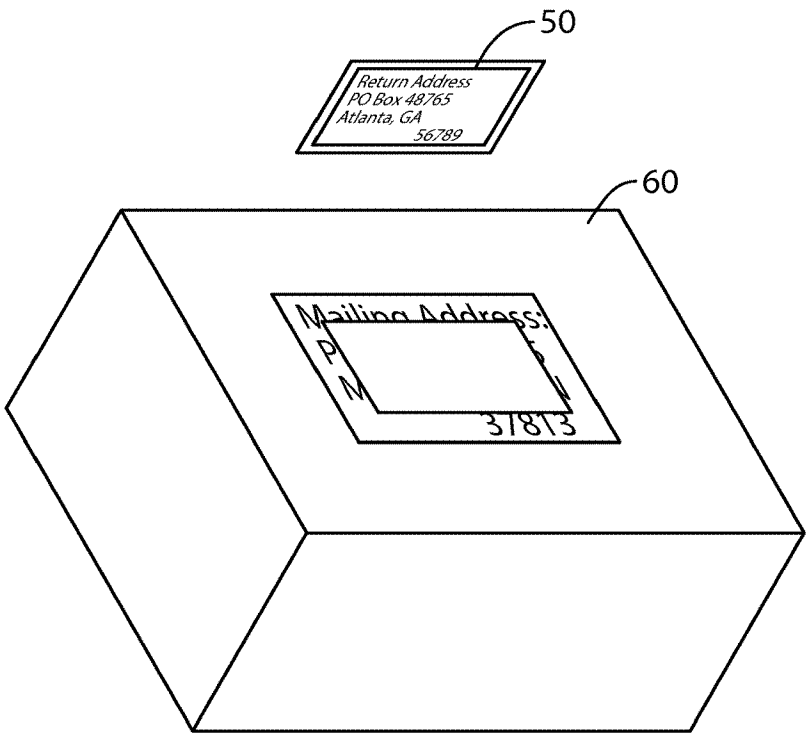
FIG. 9 is a perspective view showing return label being removed from the mailing package of FIG. 8.

As shown in FIG. 8, mailing label 40 (along with return label 50 attached on back) is applied to a mailing package 60 to be sent to the recipient indicated in the mailing address 33. After the recipient at the mailing address 33 receives the mailing package 60, the recipient can remove return label 50 from the combined label, as shown in FIG. 9. More specifically, return label 50 is removed by manipulating and breaking the perforation 18 which is formed in the first piece 10 of material (FIG. 3). The recipient at the mailing address 33 can now use the removed return label 50 to send a return package 70 (as shown in FIG. 10) to the recipient indicated in the return address 35. More specifically, return label 50 is peeled away from the first release coating 14. The corresponding glue portion which previously overlaid the first release coating 14 allows return label 50 to be applied to the return package 70.

It should be apparent that a combined mailing label and return label is provided using two pieces of one-sided thermal paper material which are joined together with a layer of pressure-sensitive adhesive therebetween. One piece of thermal paper material has a perforation and the other piece of thermal paper material has a corresponding die cut in registration with the perforation such that a mailing label (with a return label on its back) can be peeled away and applied to a mailing package. The perforation allows the recipient of the mailing package to manipulate and remove the return label from the mailing package, and thereby to expose the return address on the return address side of the return label. The removed return label can then be subsequently peeled away from a release coating material and applied to a return package.

It should also be apparent that adhesive for the mailing label and adhesive for the return label are from the same layer of adhesive which was applied to make the combined mailing label and return label. Accordingly, only one layer of adhesive is needed to manufacture the combined mailing label and return label.

It should also be apparent that the combined mailing label and return label is linerless in that there is no release liner between two pieces of thermal paper material. Since no release liner is needed, the result is less cost to manufacture the combined mailing label and return label. Also, since no release liner is needed, the combined mailing label and return label can be manufactured using simpler equipment.

Although the above description describes a rectangular-shaped mailing label 40 and a rectangular shaped return label 50 (FIG. 7), it is conceivable that other shapes are possible. Accordingly, other shapes of perforations in the first piece 10 of material (FIG. 3) and other shapes of die cuts in the second piece 20 of material are possible. Also, although the above description describes pressure-sensitive glue being applied to substantially the entire backside 12 of the first piece 10 of material, it is conceivable that only a portion or portions of the backside 12 have pressure-sensitive glue applied thereto. Any combination of shapes of perforations, shapes of die cuts, release coating patterns, and adhesive patterns may be used.

Also, although the above description describes first and second pieces of thermal paper being used to make a combined label, it is conceivable that first and second pieces of non-thermal paper may be used to make a combined label.

Further, although the above description describes a combined label used in an application as a mailing label and a return label, it is conceivable that the combined label may used in other types applications such as any type of application where a primary label and a secondary label are needed.

While the present invention has been illustrated by the description of example processes and system components, and while the various processes and components have been described in detail, applicant does not intend to restrict or in any limit the scope of the appended claims to such detail. Additional modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

What is claimed is:

1. A combined primary label and secondary label comprising:

a first piece of paper;

a first release coating disposed on a portion of the first piece of paper;

a second piece of paper;

a second release coating different from the first release coating and disposed on a portion of the second piece of paper;

an adhesive layer disposed between the first and second pieces of paper as only and just one adhesive layer such that (i) a primary label is operable to be peeled away with at least some adhesive of the adhesive layer from the second release coating disposed on the portion of the second piece of paper, and (ii) a secondary label is operable to be peeled away with at least some adhesive of the same adhesive layer from the first release coating disposed on the portion of the first piece of paper, wherein the second piece of paper is different in size from the first piece of paper and the secondary label is smaller than the primary label, and wherein the size of the second piece of paper corresponds to a smaller area of the first piece of paper; and a rectangular-shaped perforation inside borders of the first piece of paper and inside borders of an area that defines the primary label, the rectangular-shaped perforation defining a rectangular area which corresponds to a same size as a rectangle defined by the first release coating, and a back portion of the second piece of paper sharing a same adhesive from the adhesive layer disposed between the first and second pieces of paper, and wherein the primary label and the secondary label are linerless, and wherein the combined primary and secondary label includes only and just one adhesive layer as the adhesive layer for the combined primary and second label.

2. A combined label according to claim 1, further comprising a rectangular-shaped die cut in the second piece of paper defining a rectangular area which corresponds to the same size as a rectangle devoid of second release coating.

3. A combined label according to claim 2, wherein dimensions of the rectangular-shaped die cut in the second paper defines dimensions of the secondary label.

4. A combined label according to claim 1, wherein (i) the first release coating is rectangular-shaped, (ii) the second release coating is rectangular-shaped to form a rectangular area which is devoid of second release coating, and (iii) dimensions of the rectangular-shaped first release coating and dimensions of the rectangular area which is devoid of second release coating are the same.

5. A combined label according to claim 1, wherein the adhesive layer entirely covers the first release coating.

6. A combined label according to claim 1, wherein the secondary label corresponds to the same dimensions as that portion of the first paper on which the first release coating is disposed.

7. A combined label according to claim 1, wherein the first piece of paper comprises a thermal-sensitive piece of paper, and the second piece of paper comprises a thermal-sensitive piece of paper.

8. A combined mailing label and return label comprising:

a first paper having a front side and a back side;

a first thermal-sensitive coating disposed on the front side of the first paper;

a first release coating disposed on only a portion of the back side of the first paper;

a pressure-sensitive adhesive disposed on the back side of the first paper and covering the first release coating, wherein the pressure-sensitive adhesive is the only and just one adhesive layer that is disposed on the combined mailing label and return label;

at least one perforation in the first paper;

a second paper having a front side and a back side;

a second thermal-sensitive coating disposed on the front side of the second paper;

a second release coating disposed on only a portion of the back side of the second paper; and at least one die cut in the second paper, the at least one die cut in the second paper being in registration with the at least one perforation situated inside borders of the first paper and inside borders of an area defining a primary label on the first paper when the first and second papers are assembled together with their backsides facing each other such that at least some of the pressure-sensitive adhesive on the back side of the first paper faces at least some of the second release coating on the back side of the second paper to form a mailing label on the front side of the first paper and a return label on the front side of the second paper, wherein the return label is smaller than the mailing label and the second paper is different in size from the first paper, and wherein the size of the second paper corresponds to a smaller area of the first paper, and wherein the back side of the second paper shares a portion of the pressure-sensitive adhesive that is disposed on the back side of the first paper, and wherein the mailing label and return label are linerless.

9. A combined mailing label and return label according to claim 8, wherein dimensions of the at least one die cut in the second paper defines dimensions of the return label.

10. A combined mailing label and return label according to claim 8, wherein the return label corresponds to the same dimensions as that portion of the back side of the first paper on which the first release coating is disposed.

11. A combined mailing label and return label according to claim 8, wherein the first paper comprises a thermal-sensitive piece of paper, and the second paper comprises a thermal-sensitive piece of paper.

12. A method of manufacturing a combined mailing label and return label, the method comprising:

applying a first release coating to a back side of a first piece of paper;

applying an adhesive layer to the back side of the first piece of paper and covering the first release coating and applying only and just one layer of adhesive as the adhesive layer to the combined mailing label and return label;

applying a second release coating to a back side of a second piece of paper; and pressing the back sides of first and second pieces of paper together such that (i) a mailing label is operable to be peeled away from the second release coating and applied to a mailing package, and (ii) a return label is operable to be later separated along perforations inside borders of an area defining the mailing label on the mailing package and peeled away from the first release coating and applied to a return package, wherein the return label is smaller than the mailing label and the first and second pieces of paper are different sizes, and wherein the size of the second piece of paper corresponds to a smaller area of the first piece of paper, wherein the back side of the second piece of paper sharing a same adhesive from the adhesive layer as the back side of the first piece of paper, and wherein the mailing label and the return label are linerless.

13. A method according to claim 12, wherein the first piece of paper comprises a thermal-sensitive piece of paper, and the second piece of paper comprises a thermal-sensitive piece of paper.

* * * * *